US008109775B2

(12) United States Patent
Ransil et al.

(10) Patent No.: US 8,109,775 B2
(45) Date of Patent: Feb. 7, 2012

(54) JUVENILE PRODUCT ASSEMBLY WITH INTRINSIC ELECTRICAL CONNECTION

(75) Inventors: Matthew J. Ransil, Richland, PA (US); Bryan Graham, Coatsville, PA (US); Craig Desrosiers, Spring City, PA (US)

(73) Assignee: Graco Children's Products Inc., Atlanta, GA (US)

( * ) Notice: Subject to any disclaimer, the term of this patent is extended or adjusted under 35 U.S.C. 154(b) by 99 days.

(21) Appl. No.: 12/274,710

(22) Filed: Nov. 20, 2008

(65) Prior Publication Data

US 2010/0124833 A1 May 20, 2010

(51) Int. Cl.
*H01R 25/00* (2006.01)

(52) U.S. Cl. ..... 439/207

(58) Field of Classification Search ..... 439/207, 439/209, 352, 354; 472/119; 135/67; 403/109.3; 280/87.021

See application file for complete search history.

(56) References Cited

U.S. PATENT DOCUMENTS

| | | | | |
|---|---|---|---|---|
| 3,192,499 | A * | 6/1965 | West | 439/354 |
| 3,680,033 | A * | 7/1972 | Kawai | 439/352 |
| 4,875,871 | A * | 10/1989 | Booty et al. | 439/209 |
| 5,611,707 | A * | 3/1997 | Meynier | 439/353 |
| 7,185,850 | B2 * | 3/2007 | Callahan et al. | 244/118.6 |
| 2007/0207870 | A1 | 9/2007 | Armbruster et al. | |

* cited by examiner

*Primary Examiner* — Alexander Gilman
(74) *Attorney, Agent, or Firm* — Lempia Summerfield Katz LLC

(57) ABSTRACT

A juvenile product includes an electrical device, a structural assembly configured to structurally support the electrical device, and a power delivery path configured to carry power to the electrical device. The structural assembly includes first and second structural components, and is formed via a structural connection of the first and second structural components. The power delivery path is disposed within the first and second structural components, respectively, and includes first and second electrical contacts positioned relative to the first and second structural components, respectively, such that the structural connection between the first and second structural components establishes an electrical connection between the first and second contacts.

24 Claims, 11 Drawing Sheets

JUVENILE PRODUCT ASSEMBLY WITH INTRINSIC ELECTRICAL CONNECTION

BACKGROUND OF THE DISCLOSURE

1. Field of the Disclosure

The present disclosure is generally directed to child devices or juvenile products, and more particularly to electrically powered child devices and juvenile products.

2. Description of Related Art

Child swings and other juvenile products commonly include electrically powered components. The types of components vary widely, ranging from electric motors to speakers and lights of an audio-visual entertainment system, to name but a few. Most products utilize a battery power source to support these loads. As the electrical loads have increased with more complex product features and component functionality, some juvenile products have been plugged into a standard wall outlet to rely on AC line power.

Juvenile products have been constructed to deliver power from the AC line in different ways. For example, a child pendulum swing has been connected to AC line power by way of wires running along a frame leg to reach the elevated housing in which the electronics and drive mechanism are located. Assembly of the swing then requires a caregiver to connect the wires and the housing using a connector at the end of the wires. Unfortunately, both the wires and the connector are often considered unsightly.

Some juvenile products have wires running inside a frame leg. While these wires are thus hidden from view, a caregiver is forced to make electrical connections during product assembly. That is, the electrical connections must be made before access to the interior of the frame leg is foreclosed as a result of the product being assembled. The steps taken to establish these electrical connections resulted in added complexity in the assembly process. The complexity can lead to errors, thereby requiring assembly steps to be reversed, which may be impracticable or impossible.

Child swings have been equipped with a switch to select between battery-powered and AC line-powered operation. U.S. Patent Publication No. 2007/0207870 describes one example of a child swing with a switch to support these two modes of operation. A caregiver generally must choose between the two power sources, make any necessary connections, and position the switch accordingly.

BRIEF DESCRIPTION OF THE DRAWINGS

Objects, features, and advantages of the present invention will become apparent upon reading the following description in conjunction with the drawing figures, in which like reference numerals identify like elements in the figures, and in which.

DETAILED DESCRIPTION OF THE DISCLOSURE

Figure 1:
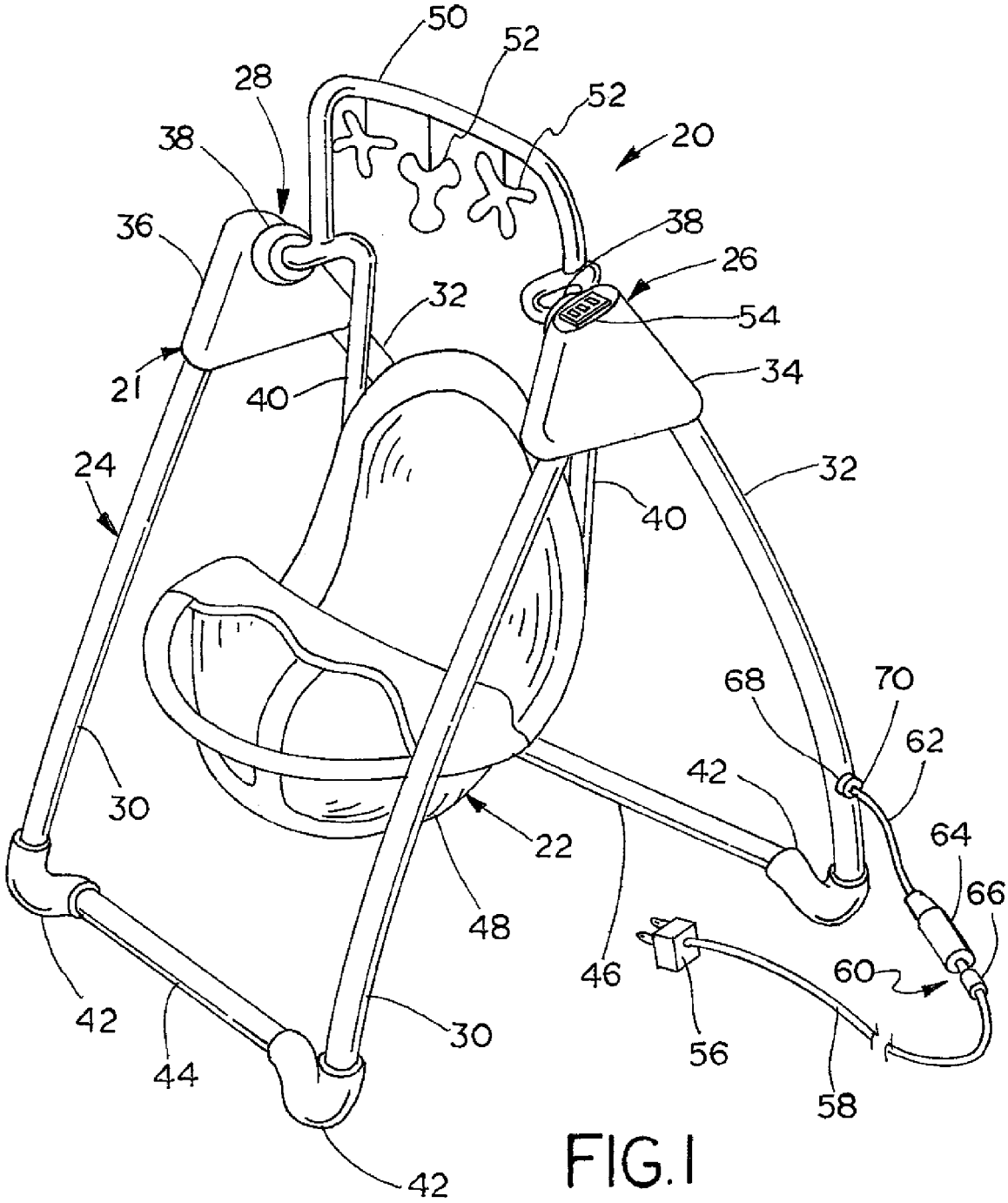
FIG. 1 is a front, perspective view of one example of a child swing constructed in accordance with several aspects of the disclosure.

The disclosure is generally directed to juvenile products or child devices having a structural assembly that intrinsically includes or establishes an electrical connection. As described below, the structural assembly includes one or more structural connections with a built-in electrical connection, thereby facilitating the delivery power from a power source, such as an AC line source. Product assembly is not complicated by the built-in electrical connection, inasmuch as the electrical connection is a direct consequence of the structural connection of a number of structural components of the assembly. In other words, the products and devices described below minimize, if not eliminate, the need for wire routing or electrical connections on the product beyond the intrinsic connection(s) formed during structural assembly.

Several aspects of the disclosure are directed to simplifying assembly, while ensuring a consistent and robust electrical connection to a power source, such as an AC line source. One way in which assembly is simplified involves not requiring a user to make electrical connections on or in the product, or within structural components thereof. In this way, these aspects achieve an aesthetically pleasing product design (e.g., the absence of external wire connections) without complicating assembly. These aspects also generally address the challenges of delivering power from an AC outlet to a load device (or devices) spaced from the floor and, for that matter, the outlet. These aspects still further address the challenge of establishing an electrical connection to load device(s) located within a housing or other enclosure. To that end, in some cases, the electrical connection is established within the device housing. In these and other cases, the electrical connection is established using a frame leg or other frame component that is axially connected to another structural component. In those cases, the electrical contacts may be configured and aligned so that an electrical connection is made even when the frame leg moves axially. A number of other challenges are also addressed, including establishing an electrical connection in a safe and effective manner, and the protection of contacts or other components of the electrical connection during shipping and before assembly.

These and other aspects of the disclosure are compatible with products that are both battery-powered and powered via an intrinsic electrical connection to the AC line. In some examples, these power sources are coupled to the electrical load(s) via a circuit having one or more isolation diodes. The circuit generally allows the product to automatically switch between the AC line power and the battery power in a safe and convenient manner. In this way, a caregiver may safely elect to use the product with both batteries and a wall plug connection to the AC line present. In one example, the isolation diode(s) of the circuit prevents conflicts between the two power sources from arising, thereby avoiding, for instance, two sources competing to establish a voltage level, or a reverse current flow through the batteries. In this way, the circuit described below helps maintain a stable and safe supply voltage for the electrical load(s).

Although described below in connection with a child pendulum swing, these and other aspects of the disclosure are well-suited for any juvenile product or child device, including, for instance, bouncers, rockers, cribs, and playards. Thus, the examples described below are set forth with the understanding that the disclosure is not limited to child pendulum or other swings, or the other products identified above. Moreover, the nature of the electrical load need not involve a drive mechanism or, for that matter, any motion whatsoever.

Turning now to the drawing figures, FIG. 1 depicts an exemplary child swing 20 with a structural assembly 21 having a number of structural components arranged in an A-frame configuration to suspend an occupant seat assembly 22 above a floor surface. The structural assembly 21 of the swing 20 generally includes a structural frame 24 and a pair of pivot joints 26, 28. The frame 24 includes pairs of front legs 30 and rear legs 32 that extend upward from the floor surface and either rearward or forward to meet at one of the pivot joints 26, 28. Located at the pivot joints 26, 28 are housings 34, 36 in which top ends of the legs 30, 32 are received. The pivot joints 26, 28 also include respective hubs 38 to support the reciprocal motion of the swing 20. To that end, hanger arms 40 extend from the pivot axis defined by the hubs 38 to support the seat assembly 22. In this example, the hanger arms 40 are bent rearward from the pivot axis before turning downward for coupling to the seat assembly 22.

The frame 24 may also include a number of other structural components to provide support for the swing 20. In this example, feet 42 are disposed at lower ends of each leg 30, 32 to provide a stable foundation for the assembly 21 when resting on the floor surface. A cross bar 44 couples the feet 42 of the front legs 30, while a cross bar 46 couples the feet of the rear legs 32. Together, the front legs 30, the rear legs 32, the crossbars 44, 46, and the feet 42 form a support base or stand for the swing 20 and any one or more operational components or devices thereof. Above the support base, the frame 24 may include a seat frame 48 and one or more entertainment bars 50. In this example, the entertainment bar 50 extends upward from and between the hanger arms 40 such that one or more entertainment items 52 may be suspended above the seating area defined by the seat assembly 22.

Generally speaking, the swing 20 includes a number of components or devices configured for electrically powered operation. In many cases, these components or devices are directed to entertaining or soothing the child occupant. Operation of the components or devices may involve movement, sound, lighting and other visual stimuli, or any combination of these and other actions or activities. The swing 20 generally includes a drive mechanism (not shown) enclosed in the housing 34 and/or the housing 36 for imparting movement to the hanger arms 40 and thereby giving rise to the reciprocating motion of the seat 22. As described further below, the drive mechanism may include a DC electric motor. The swing 20 also includes a control panel 54 disposed on the housing 34 and configured to control the operation of the drive mechanism and other devices and components. For instance, the control panel 54 may have a number of buttons or switches to select music or sounds for playback to soothe the child occupant. The control panel 54 may include a number of electrically powered lights or other visual elements to indicate an operational status or provide other information to the caregiver. In this example, the entertainment items 52 may also be electrically powered to include, for instance, lights or motion.

In accordance with one aspect of the disclosure, AC line power acts as a power source for the above identified components and devices (and other electrically powered components or devices of the swing 20). As described further below, the power derived from the AC line is routed to the swing 20 from an AC wall plug outlet (not shown) via an AC adapter or AC-to-DC converter 56, a cord 58 extending from the converter 56, an external or off-board coupling 60, and a cord 62 coupling the connection to the structural assembly 21 and, in this case, the frame 24. The AC-to-DC converter 56 is generally configured to down-convert or step down the AC line voltage (e.g., 110 V) to a lower DC voltage level (e.g., 6 V). In this way, the voltage step-down safely occurs at the wall (i.e., remotely from the product) rather than on-product, although in some cases the 110 V supply may be delivered to the product. The DC voltage is then carried via the cord 58 to complementary connector jacks 64 and 66 of the coupling 60. The jacks 64, 66 may be configured to establish the connection in any desired manner (e.g., press-fit, magnetic, etc.), but are generally cooperatively shaped to engage one another for a suitably low resistance connection. In this case, the connector jack 66 is configured as the jack plug of the connection. However, the coupling 60 need not rely on, or be limited to, a typical plug-socket arrangement, as in the example shown. In some cases, the connector jack 66 includes one or more safety features to ensure that the DC voltage level is not easily or readily accessed at the connector jack 66 or, more generally, the connection between the jacks 64, 66.

The external routing of the line-derived power is generally configured to provide a safe and convenient delivery of power from the AC wall outlet. To this end, the cord 62 may extend from a port 68 located on one of the rear legs 32 at a relatively low height or position. In that way, the external delivery path can transition to an internal delivery path as soon as possible. The cord 62 may also be relatively short, extending only a short distance from the leg 32 or, more generally, the frame 24, to minimize the extent to which the cord 62 presents a hazard when not in use. For example, the length of the cord 62 may be short relative to the length of the cord 58. In some cases, the cord 62 has a length insufficient to reach the floor surface, even though the cord 62 may project from the housing 24 at the low height shown in FIG. 1.

The coupling 60 may, but need not, be configured with a quick release or disengagement feature to avoid the creation of a trip hazard via the external routing of the line-derived power. In this example, the connector jacks 64 and 66 of the coupling 60 can be readily disengaged. In this way, the extent to which the cords 58 and 62 are disposed remotely from the structural assembly 21 also does not pose a safety problem for the child occupant. The force required to disconnect or disengage the jacks 64 and 66 may thus be relatively low, and may be substantially lower than the force involved in overcoming a retaining grommet 70 disposed in the port 68. As a result, the jacks 64 and 66 disengage before any permanent damage occurs to the components involved in the internal or on-board routing of the line-derived power.

The structural components and characteristics of the assembly 21, the frame 24, the housings 34, 36, and any other component of the swing 20 may vary considerably from the example shown. The legs 30, 32, for instance, may be arranged in a variety of configurations to form different support bases or stands for the swing 20 and its operational devices and components.

The motion characteristics of the swing 20 may also vary considerably. The arrangement or configuration of structural components may thus vary accordingly. For instance, some alternative swing designs involve a single arm cantilevered from an upstanding post. Several examples of such alternative swings are described in commonly assigned and co-pending U.S. application Ser. No. 11/385,260, entitled "Child Motion Device," and published under U.S. Patent Publication No. 2007/0111809, the entire disclosure of which is hereby incorporated by reference.

Figure 2:
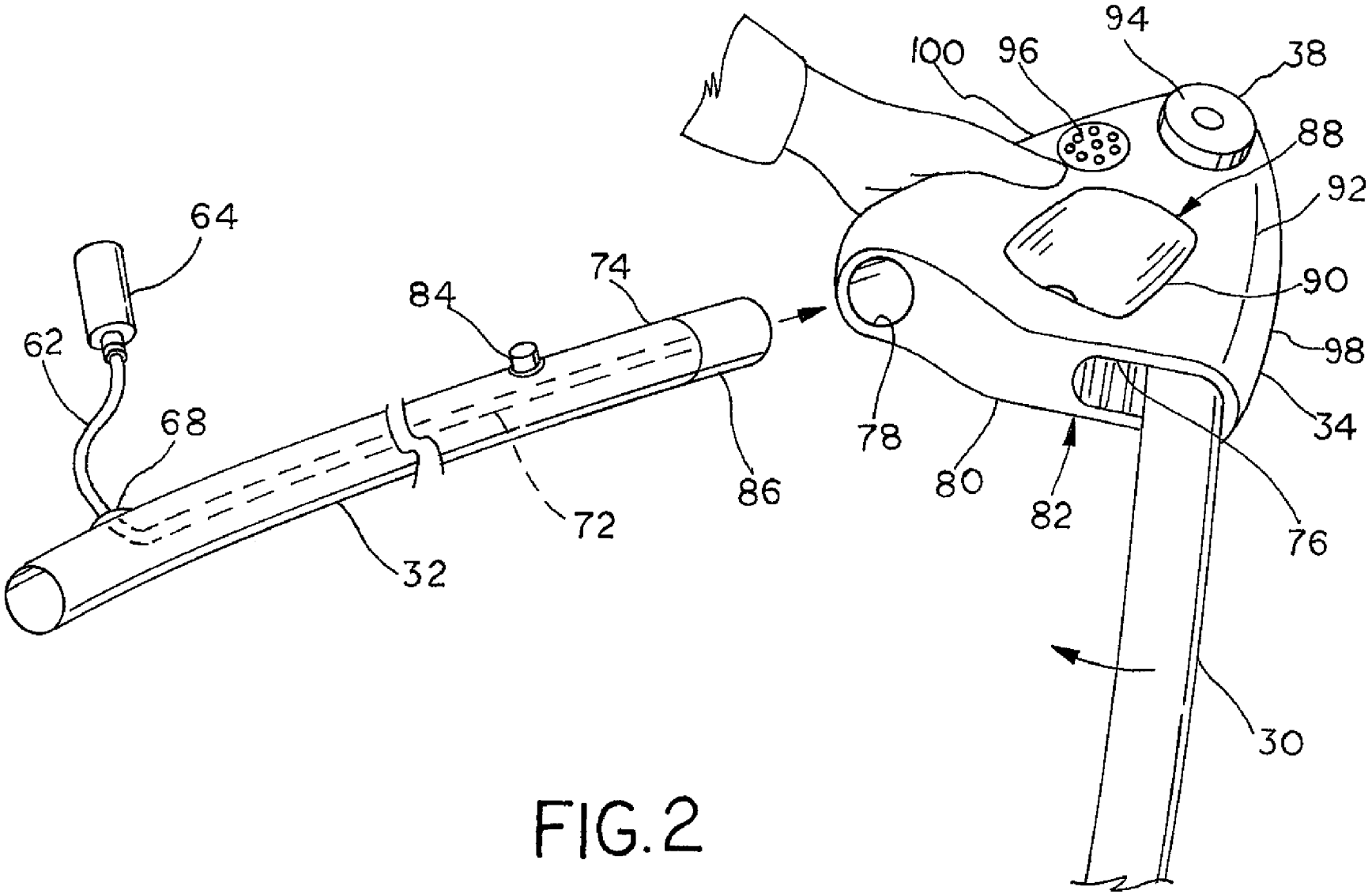
FIG. 2 is an exploded, perspective view of a structural assembly of the child swing of FIG. 1 in which a device housing and two frame legs have a structural connection with an intrinsic electrical connection in accordance with an exemplary embodiment.

FIG. 2 depicts the assembly of several structural components of the exemplary swing 20 in greater detail to show several aspects of the internal or on-board routing of the line-derived power. In this example, the line-derived power is routed through one of the rear legs 32 after entering the frame 24 at the port 68 via the cord 62 and the connector jack 64. To that end, a cord 72 generally runs the length of the leg 32, from the port 68, through an interior of the leg 32, eventually reaching a top end 74 of the leg 32. The leg 32 (and other legs of the frame 24) may be tube-shaped to provide an open interior. Alternatively or additionally, the leg 32 includes an interior tube or conduit (not shown) through which the cord 72 runs. More generally, the cord 72 may be routed through the interior of the leg 32 in any desired manner, and through any desired conduit. Due to the protection from the leg 32 or any internal conduit, the cord 72 may, but need not, differ from the cords 58 and 62. As a result, the internal routing of the line-derived power may include or involve any type or form of two-wire pair or other wiring, and a variety of different insulation or protective sleeve arrangements.

During assembly of the swing 20, the front and rear legs 30 and 32 are secured within respective slots 76, 78 in the housing 34 in position for the A-frame configuration. In this example, both of the slots 76, 78 are formed in a downward facing surface 80 of a lower or bottom side 82 of the housing 34. As a result, the legs 30, 32 are inserted in a generally upward direction into the housing 34 via the slots 76, 78, respectively. The front leg 30 pivots within the slots 76 to move from a position in which the frame 24 is oriented in a folded configuration to the position shown in FIG. 2 in which the frame is oriented in the A-frame, in-use configuration. To that end, the slot 76 is elongated or widened to allow the pivoting motion. In contrast, the slots 78 presents a generally circular opening through which the leg 32 is inserted, although a variety of other shapes may be used to correspond with differently shaped tubes or legs. The leg 32 is inserted into the slot 78 and, thus, the housing 34, until a snap button 84 engages a snap connector disposed within the housing 34. Further details regarding the connection are provided below in connection with multiple exemplary snap connections. In general, however, the engagement of the snap button 84 and the housing 34 establishes a structural connection between the leg 32 and the housing 34, thereby securing the leg 32 in position within the housing 34. That said, the structural connection need not involve a snap connector or connection, but rather include or involve any type of fastener or fastening arrangement.

Figure 10:
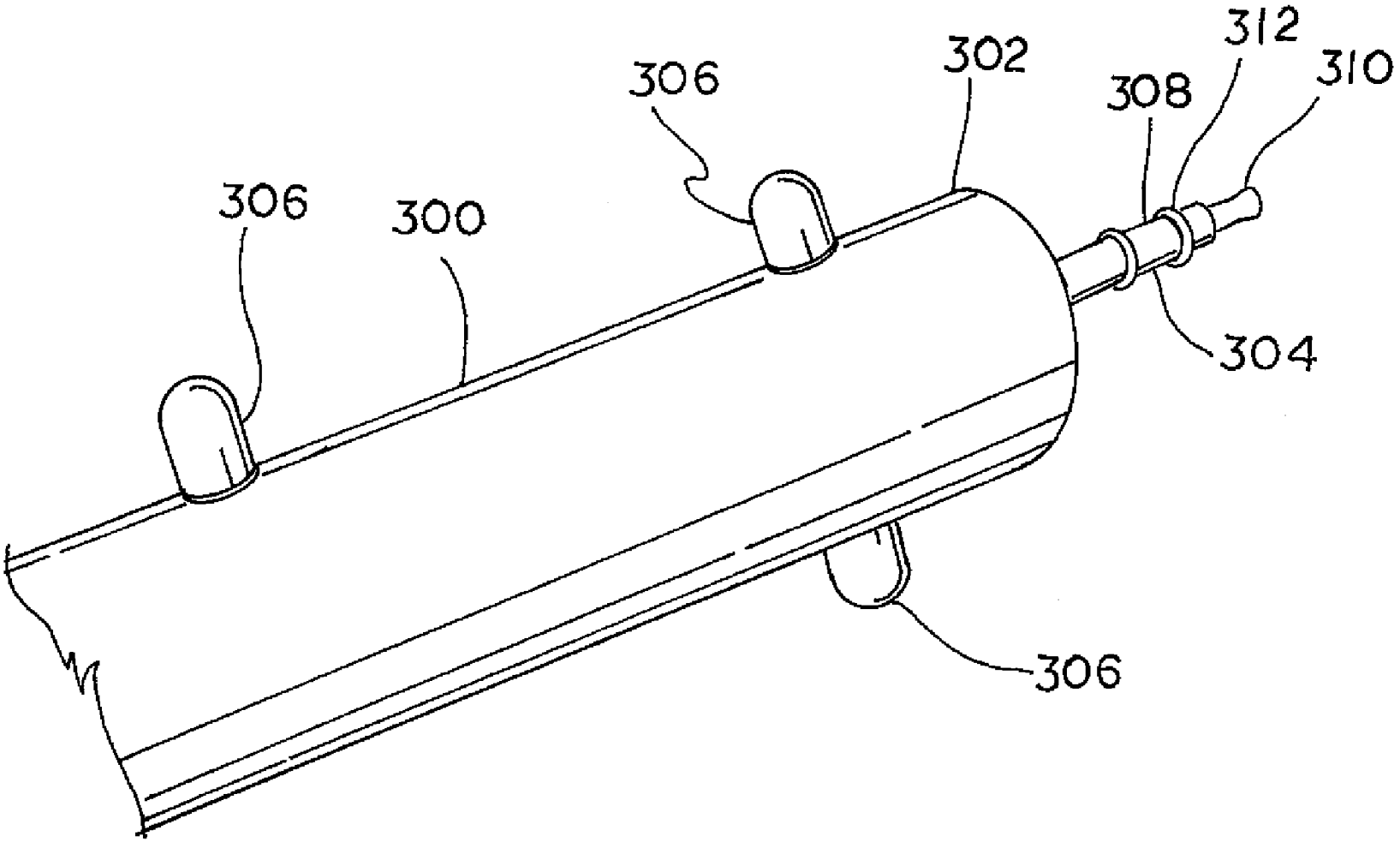
FIG. 10 is a partial, perspective view of an exemplary frame leg having an electrical connector constructed in accordance with an alternative embodiment.

In accordance with one aspect of the disclosure, the structural connection of the leg 32 and the housing 34 forms an intrinsic electrical connection for delivering the line-derived power. As described below, the leg 32 and the housing 34 are generally configured to include respective contacts or contact assemblies that are positioned for establishing a power delivery path with a built-in electrical connection resulting from the structural assembly process. In this example, the contacts or contact assemblies are disposed internally, i.e., within both of the respective structural components. In this way, the contacts or contact assemblies are generally protected from damage during shipment and otherwise before assembly, as well as protected from damage during use (i.e., after assembly). Nonetheless, the internal disposition of the elements establishing the electrical connection is not necessary, as the structural connection may be, for instance, partially or wholly exposed or otherwise accessible from the exterior of the housing 32. Moreover, one of the elements establishing the electrical connection may be external to the structural component, as shown in the example of FIG. 10. More generally, the cord 72 or other line carrying the power derived from AC line is coupled to the contacts or contact assembly within the leg 32. In this example, contacts are carried within an end plug 86 inserted into the upper end 74 of the leg 32. The end plug 86 and the leg 32 have a generally similarly shaped cross-section so that the end-plug 86 can lead the insertion of the leg 32 into the slot 78 during assembly.

The housing 34 includes a battery compartment 88 configured to contain a battery back or set of individual battery cells so that the electrical components and devices of the swing 20 can also be operated under battery power. The battery compartment 88 is accessed via a removable panel or door 90 disposed in a lateral side 92 of the housing 34. The lateral side 92 faces inward, or toward the seat (FIG. 1). A hub 94 of the pivot joint 38 is positioned on the lateral side 92 of the housing 34 so that one of the hanger arms 40 (FIG. 1) can extend inward, or toward the seat 22. The lateral side 92 also includes a speaker 96 for directing music or other sounds toward the child occupying the seat. These and other aspects of the housing 24 may vary considerably from the example shown. For example, the battery compartment 88, the hub 94, and the speaker 96 need not be located on the lateral side 92, and may be re-positioned or otherwise re-configured as desired. Nonetheless, in some cases, the positioning of the battery compartment 88, the hub 94, and the speaker 96 shown in FIG. 2 may be useful for providing room for the leg 30 to pivot within the housing 34, and room for the intrinsic electrical connection with the end plug 86 inside the housing 34. For instance, the battery compartment 88 is centrally located within the housing 34 so that each of the legs 30, 32 can be received within the housing 34 closer to forward and rearward sides 98, 100 of the housing 34, respectively.

Figure 3:
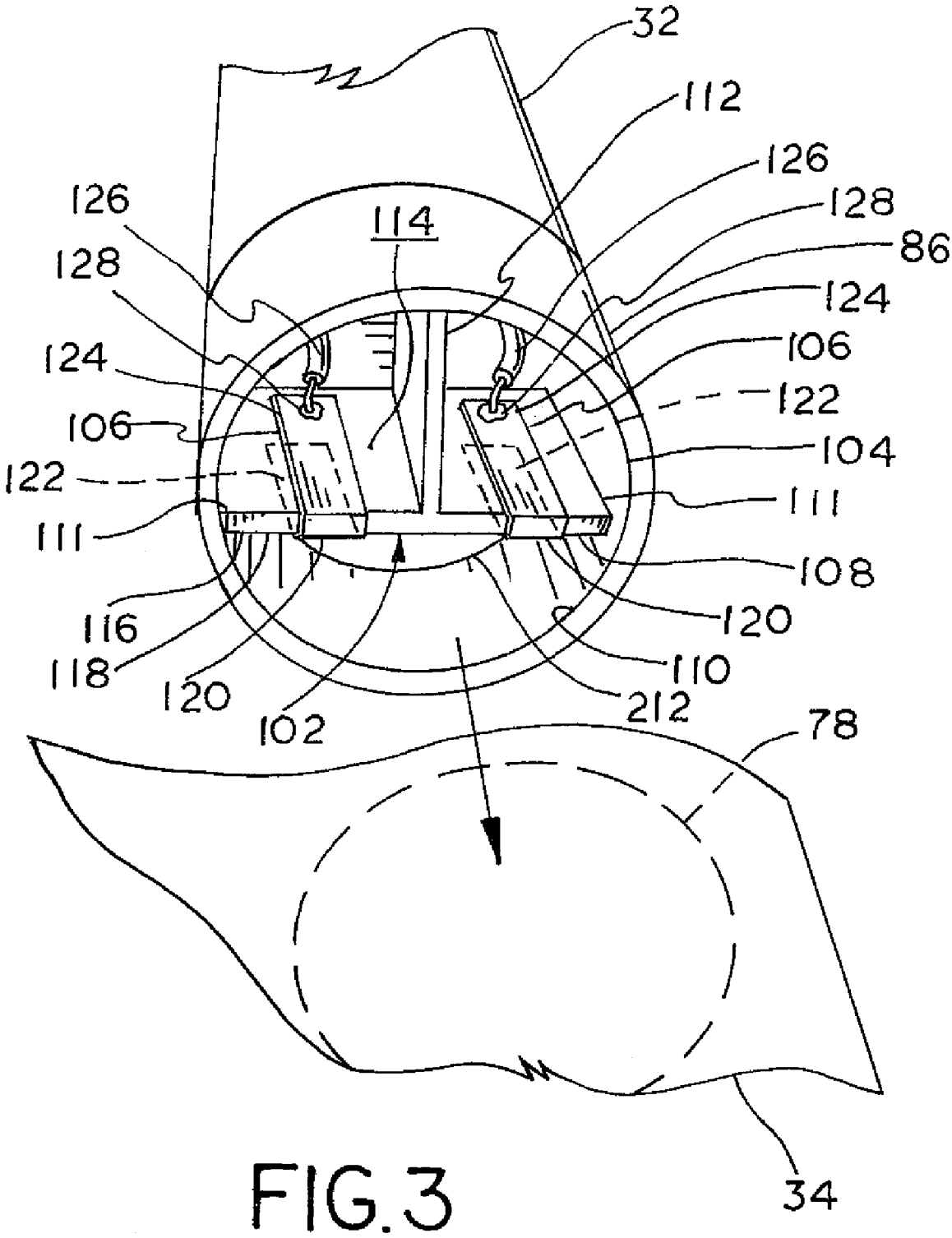
FIG. 3 is a perspective view of an exemplary frame leg of the structural assembly of FIG. 2 with an end plug constructed in accordance with several aspects of the disclosure to establish the intrinsic electrical connection.

With reference now to FIG. 3, the end plug 86 includes a contact assembly 102 configured to establish the intrinsic electrical connection when the leg 32 is inserted into the housing 34. To this end, and as described below, the end plug 86 presents one or more structural features that help align the contact assembly 102 with a corresponding contact assembly within the housing 34. The contact assembly 102 is disposed within an open-ended, cylindrically shaped front (or leading) section 104 of the end plug 86. The contact assembly 102 includes a pair of contacts 106 mounted on a platform 108 that may extend diametrically across the section 104. However, the platform 108 need not be oriented within the cylindrically shaped section 104 as shown. For example, in some embodiments, the platform 108 may extend along a non-diametrically oriented segment. The platform 108 may be secured to an inner wall 110 of the section 108 at lateral ends 111 thereof and via one or more radially extending support walls 112. This example includes a single wall 112 extending orthogonally from a central line of the platform 108. As a result, the wall 112 divides the platform 108 into two distinct regions isolated or separated from one another to prevent or help avoid electrical shorts. The platform 108 may be shaped as a plank or slab with generally flat, opposite surfaces 114 and 116. The plank terminates at a front or leading edge 118. Together, these and other aspects of the end plug 86 may serve as alignment aids in establishing the structural and electrical connections.

The contact assembly 102 includes a pair of contacts 120 that engage the surfaces 114 and 116, and wrap around the front edge 118 as clips. In this example, the clip-shaped contacts 120 are U- or V-shaped to create a pressure fit on the platform 108. In other cases, the contacts 120 may be secured to one or both surfaces 114, 116 of the platform 108 via any number or type of fasteners.

When the contacts 120 are shaped as clips as shown, the contacts 120 may have a two-sided configuration well-suited for establishing the intrinsic electrical connection. Each contact 120 has a connection side or interface 122 disposed on one side of the platform 108 and configured to engage a corresponding contact disposed within the housing 34. Each contact 120 also has a connection side or interface 124 disposed on the other side of the platform having a surface area sufficient for connection with wiring 126 at a solder bump 128. In this way, the connection interfaces 122, 124 are spaced from one another and disposed on opposite or different surfaces. As a result, the solder bumps 128 do not impede or obstruct the electrical connection as the leg 32 slides into position within the housing 34. More generally, this configuration of the contacts 120 (e.g., the spacing and positioning of the connection sides 122, 124) allows the electrical connection to be established via sliding movement in a single direction along the principal axis of the leg 32. Nonetheless, in other cases, the connection may involve additional or alternative movement to the axial sliding described above, including, for instance, a twisting motion or other rotational movement that locks the leg 32 in position and/or establishes the electrical connection.

In this example, the connection interface 122 of each contact 120 includes a flat strip that lies flat against the surface 116 of the platform 108. When the leg 32 is inserted into the housing 34, the strip is engaged by a corresponding contact within the housing 34, as described in the examples below. In other cases, the connection interface 122 may be wholly or partially spaced from the platform 108 to act as a spring. When the contact 120 includes a strip similar to the one shown in FIG. 3, the spring may be configured as a flat spring that compresses toward the platform 108 as the leg 32 is inserted into the housing 34. In some cases, the contact 120 is oriented and positioned such that the motion of the spring is in a direction normal or orthogonal to the movement establishing the structural connection (e.g., the axial movement of the leg 32). In this way, the contact is aligned and positioned to establish an electrical connection even when the leg 32 moves axially. In some cases, the electrical contact in the other structural component (e.g., the leg 32) may be configured with a spring arranged in this manner. More generally, each contact 120 may be configured as any type of spring for elastic compression when the leg 32 slides into position within the housing 34. For example, each contact 120 may be bent to slope and extend away from the platform 108 as, for instance, a cantilever spring. In these cases, the connection interface 122 is spaced from the platform 108 to a variable extent depending on the engagement of the contact within the housing 34.

Figure 4:
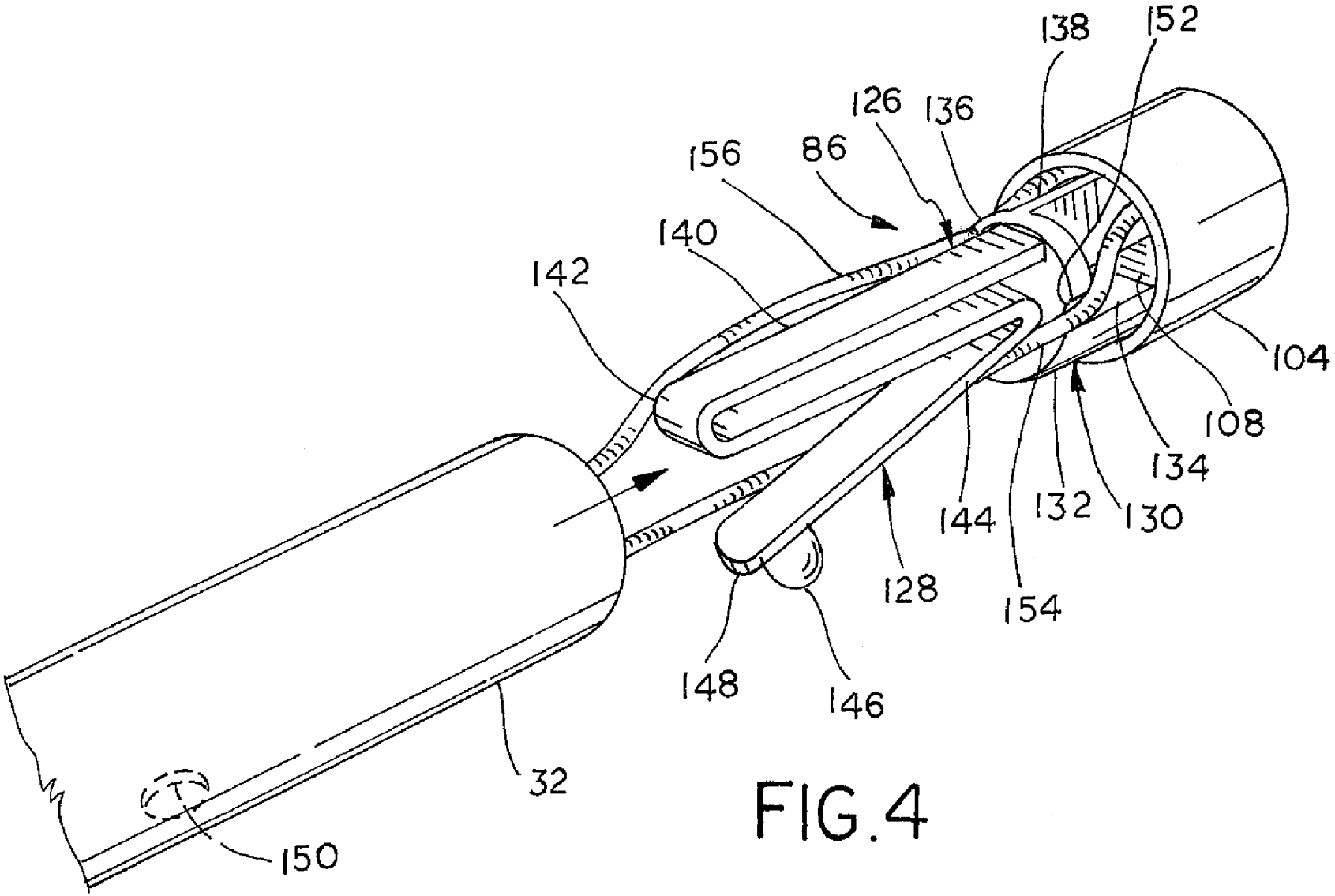
FIG. 4 is an exploded, perspective view of the frame leg and the end plug of FIG. 3 to show the end plug in greater detail.
Figure 5:
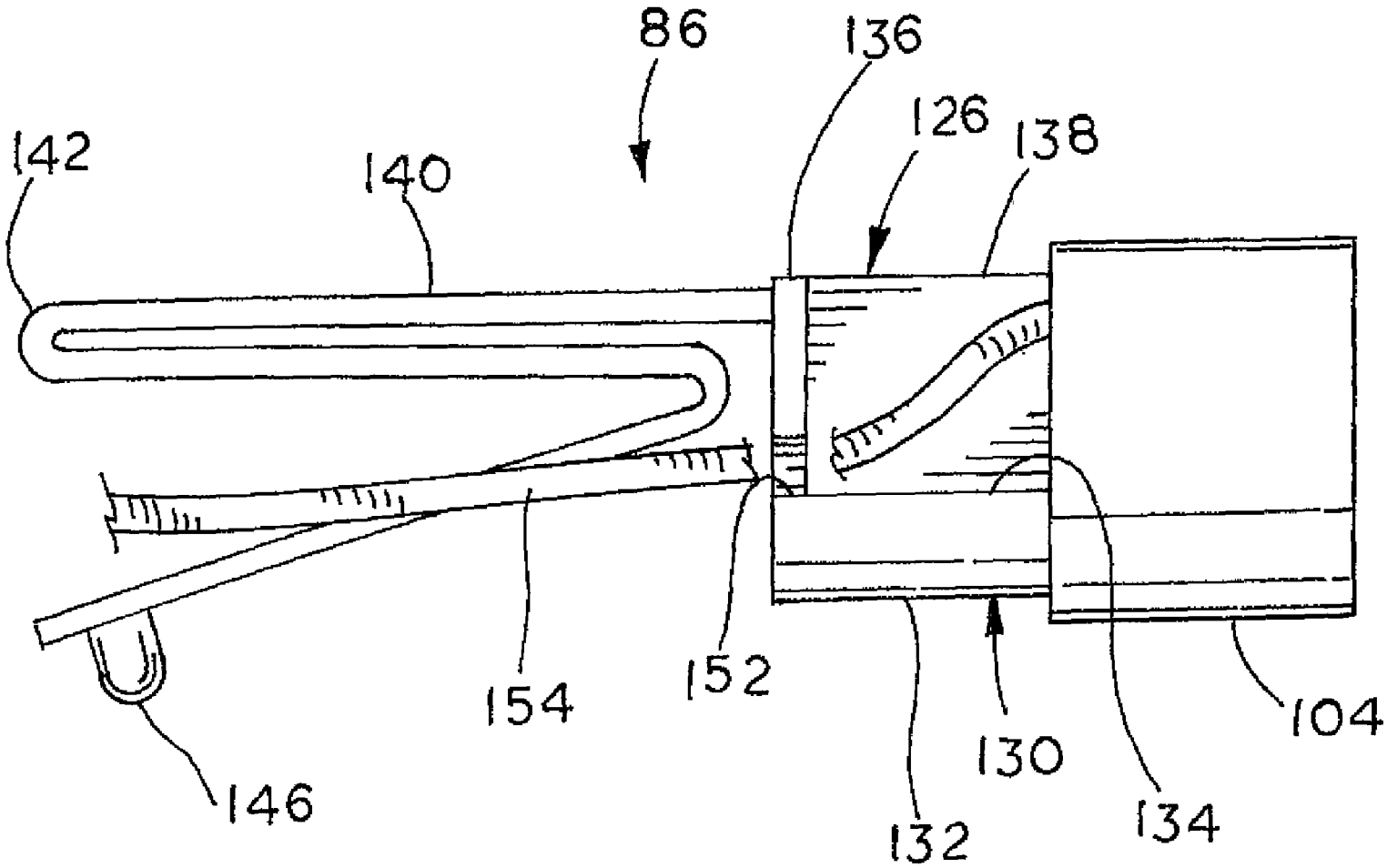
FIG. 5 is a side, elevational view of the end plug of FIG. 3.

FIGS. 4 and 5 depict the end plug 86 in greater detail, including the manner in which the end plug 86 engages the leg 32. The front or leading section 104 of the end plug 86 is supported by a rear insert or coupling section 126 configured to link to the end plug 86 to the leg 32. The insert section 126, in turn, includes a connector segment 128 and an infrastructure or base segment 130 from which the connector segment 128 and the front or leading section 104 extend in opposite, axial directions. The base segment 130 is generally cylindrically (or half-cylindrically) shaped to snugly fit within the end opening of the leg 32. In this case, the base segment 130 includes a half-cylinder plug or insert 132 that forms a floor or base surface 134 from which the platform 108 extends as a shelf at the outer end of the insert 132. In some cases, the platform 108 is an integral extension of the insert 132. More generally, any group of the non-electrical components of the end plug 86 or the insert section 126 may be integrally formed as a single molded component. At the other end of the insert 132, a disc-shaped wall 136 acts as a foundation for the connector segment 128 and a support wall 138, which may be integrally formed or connected with the support wall 112 (FIG. 3). The disc-shaped wall 136, the support wall 138, and the half-cylinder insert 132 may have a radial extent or size that corresponds with the inner wall of the leg 32. In this way, the end plug 86 fits snugly within the leg 32 to prevent any relative radial displacement after assembly.

The connector segment 128 in this example includes a snap connector 140 configured to engage the leg 32 to secure the end plug 86 in position. The snap connector 140 may be arranged to engage the leg 32 via a wide variety of snap-fit configurations. For example, any one of a number of different cantilever-based structures may extend axially into the leg 32 from the base segment 130 of the end plug 86 to engage a corresponding recess or other structure therein configured to receive a projection of the cantilever. In this example, the structure includes a serpentine extension 142 mounted to, and extending axially away from, the disc-shaped wall 136 that doubles over to form a V-shaped spring 144 having a button-shaped projection 146 at a terminal end 148. The button 146 is shaped to engage a hole 150 formed in the leg 32. In this example, both the button 146 and the hole 150 have corresponding round shapes, although a variety of other shapes may alternatively be used for the projection and recess of the snap connection. More generally, the exemplary snap connection shown is configured for convenient disassembly, as the snap button 146 may be accessed from the outside of the leg 32. As described below, the extent to which the snap button 146 extends through the hole 150 may also be useful for securing the leg 32 to the housing 32 (FIGS. 2 and 3).

The insert section 126 is generally configured to allow wiring carrying the line-derived power to pass through the end of the leg 32 to reach the contact assembly 102 (FIG. 3). To that end, the disc-shaped wall 136 includes a pair of notches 152 shaped to allow lines or wires 154, 156 to pass through the insert section 136 of the end plug 86. In this way, the wires 154, 156 do not interfere with the tight fit of insert section 126 and the leg 32 described above.

In an alternative embodiment, the connector segment 128 may be structurally separated from those components directed to supporting the electrical connection. For example, the snap connector 140 and the button 146 may be contained within the leg 32 as a component distinct from the conducting components of the front section and any supporting components of the base segment 130. Thus, the end plug need not be formed from a single integral mold, and the contact-related components may be secured in place within the leg 32 via a different fastener than the one involved in securing the leg 32 to the housing 34.

Figure 6:
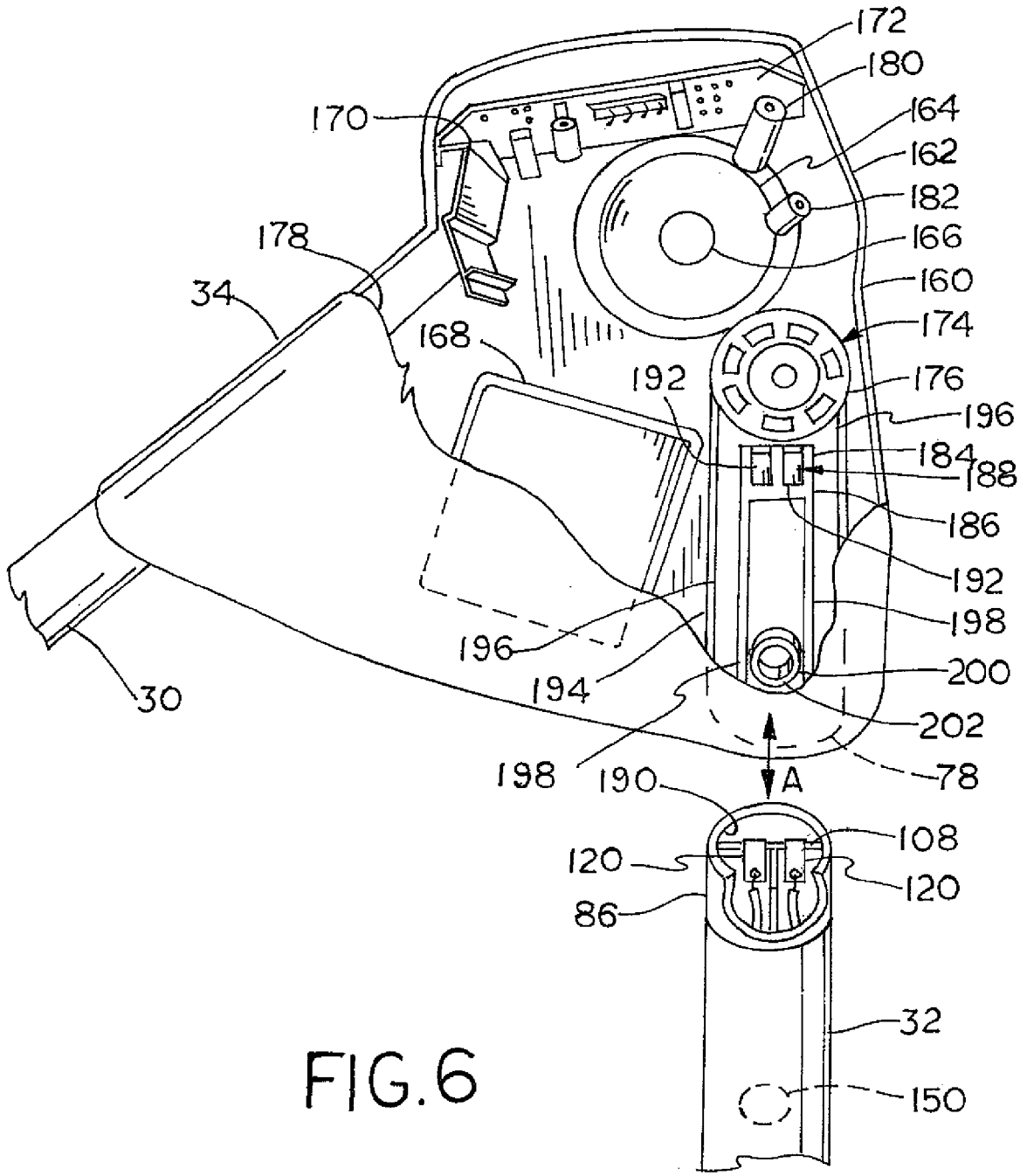
FIG. 6 is a side, elevational view of the structural assembly of FIG. 2 with the device housing fragmented to depict a housing shell constructed in accordance with several aspects of the disclosure to establish the intrinsic electrical connection.

With reference now to FIG. 6, further details regarding the other part of the intrinsic electrical connection are now provided in connection with an exemplary shell 160 of the housing 34. The shell 160 has a two-piece, molded construction in this example, one of which is shown in fragmented view to reveal an interior space for devices and structures enclosed within the housing 34. The structural aspects of the housing 34 generally involve the engagement of the legs 30, 32 within the interior space, as well as the pivotal coupling with one of the hanger arms 40 (FIG. 1). Many of these structural components and aspects are not shown in FIG. 6, or shown in simplified form, in favor of, and for ease in, illustrating the components and aspects of the housing 34 involved in forming the structural connection with the leg 32 and the intrinsic electrical connection thereof Nonetheless, the housing 34 is described below with the understanding that the two-piece shell defines or forms a number of other devices, components, and other elements. For instance, the shell 160 includes an inward facing half-shell 162 that defines a hub section 164 with a pivot shaft aperture 166 for the hanger arm 40, a box-shaped recession 168 for the battery compartment 88 (FIG. 2), an electronics platform 170 to support and position a circuit board 172 below the user interface panel 54 (FIG. 1) to receive input signals from the switches and buttons thereof, and a speaker chamber 174 in which a speaker basket 176 is seated. An outward facing half-shell 178 may define a number of additional structural components or features, as well as elements directed to connecting the two half-shells 162, 178 together. For example, the outward facing half-shell 178 may include a number of fastener holes (not shown) positioned to align with corresponding fastener-receiving posts 180, 182 or other structures.

The elements and features of the housing 34 involved with the intrinsic electrical connection are now described. Like the end plug 86 described above, the housing 34 has one or more structural features configured to act as an alignment aid in helping direct the structural components to establish the electrical connection. The inward facing half-shell 162 has a number of components positioned relative to the hole 78 for engagement with the leg 32. During assembly, the leg 32 is inserted through the hole 78 in the axial direction A to an extent that the contact assembly 102 within the end plug 86 of the leg 32 reaches and touches a contact assembly 184 disposed within the housing 34. The contact assembly 184 includes a platform 186 to support a pair of contacts 188 spaced from one another thereon. The contacts 188 are generally mounted and oriented to extend in the axial direction A to coordinate with the axial movement of the contact assembly 102 during assembly. In this example, the contact assembly 184 is positioned relative to the half-shell 162 at a height for alignment with, and insertion in, an opening 190 defined by the end plug 86. As described further below, the contact assembly 184 has an axial profile shaped to be cooperatively received within the opening 190. As a result, exposed faces 192 of the contacts 188 can slidably engage the portions (i.e., the connection interfaces 122) of the contacts 120 disposed on the platform 108 within the opening 190.

The contact assembly 184 is generally disposed at the end of a slot or groove 194 that extends into the housing 34 from the hole 78. The slot 194 may be defined by a number of guides or retaining walls, including in this example outer rails 196 and inner rails 198. In some cases, the guides or retaining walls may be integrally formed with either one of the half-shells 162, 178. More generally, the outer and inner rails 196, 198 and other guides or retaining walls run along a direction parallel to the axial direction A to retain the leg 32 within the housing 32 both during and after assembly, as well as direct the end plug 86 toward the contact assembly 184. In this example, the leg 32 may ride on the inner rails 198 during assembly (e.g., the movement in the axial direction A), while being contained from non-axial movement by the outer rails 196. The inner rails 198 may also serve another function, extending to a height relative to the half-shell 162 to position the leg 32 at a height relative to the half-shell 162 that aligns the opening 190 with the contact assembly 184. The outer and inner rails 196, 198 may form part of an injection mold distribution that forms other parts of the molded structure. The outward facing half-shell 178 may also include any number of guides, rails, or walls (not shown) for retaining and guiding the leg 32.

The half-shell 162 also includes a cylindrical recess 200 or other structure configured to complete the snap-based structural connection with the leg 32. The recess 200 is spaced axially from the contact assembly 184 a distance that corresponds with the length of the snap connector described above (FIG. 4). More specifically, the recess 200 is configured to receive the snap button 146 (FIG. 4) that extends through the hole 150 formed in the leg 32. In this way, the leg 32 snaps into a fixed position within the housing 34 in which the contact assemblies 120 and 184 are engaged to establish the electrical connection. In some cases, the recess 200 may be formed from a circular wall 202 integrally formed with the inner rails 198 as part of a common mold.

Figure 7:
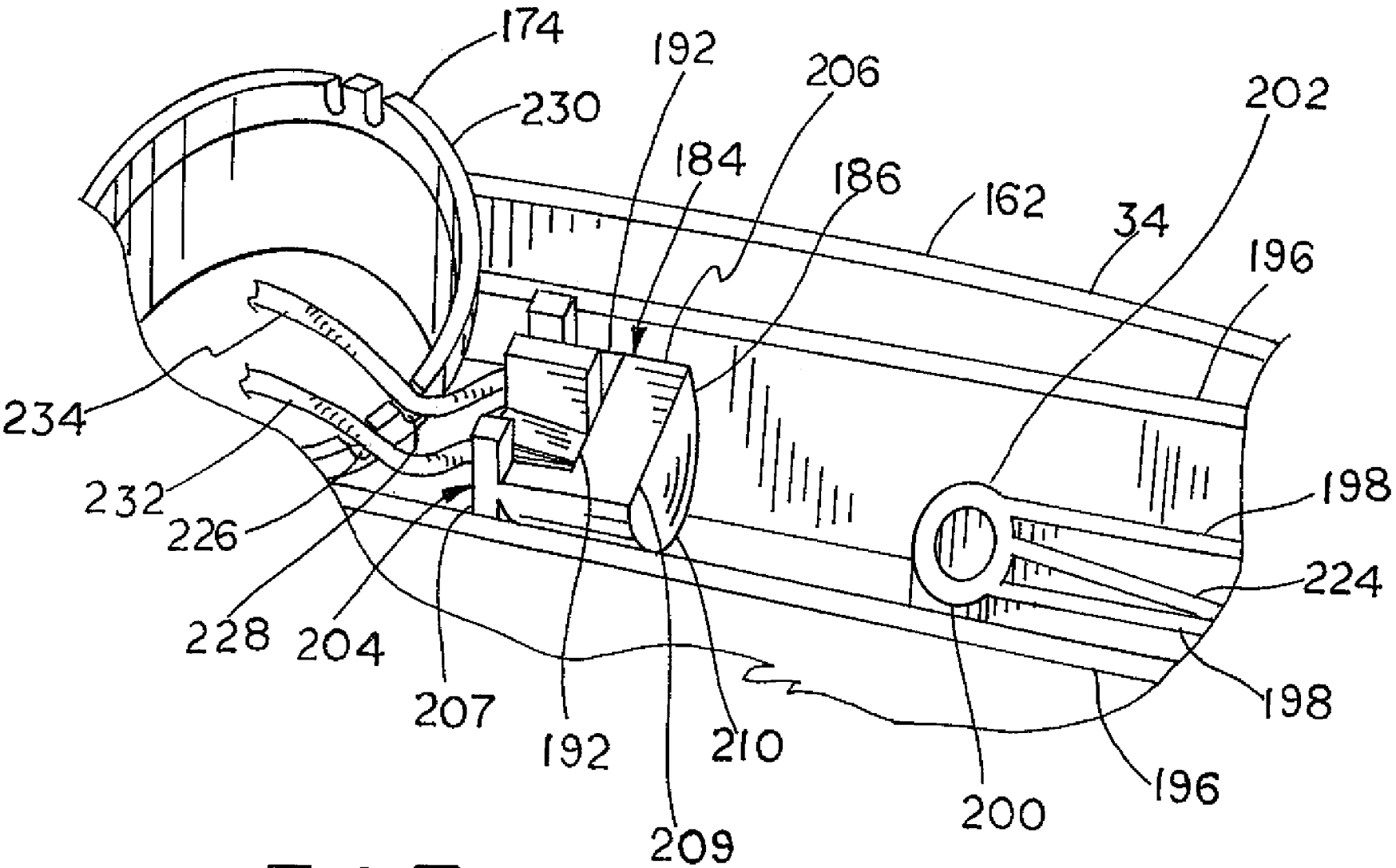
FIG. 7 is a partial, perspective view of the device housing shell of FIG. 6 to show the intrinsic electrical connection in greater detail.
Figure 8:
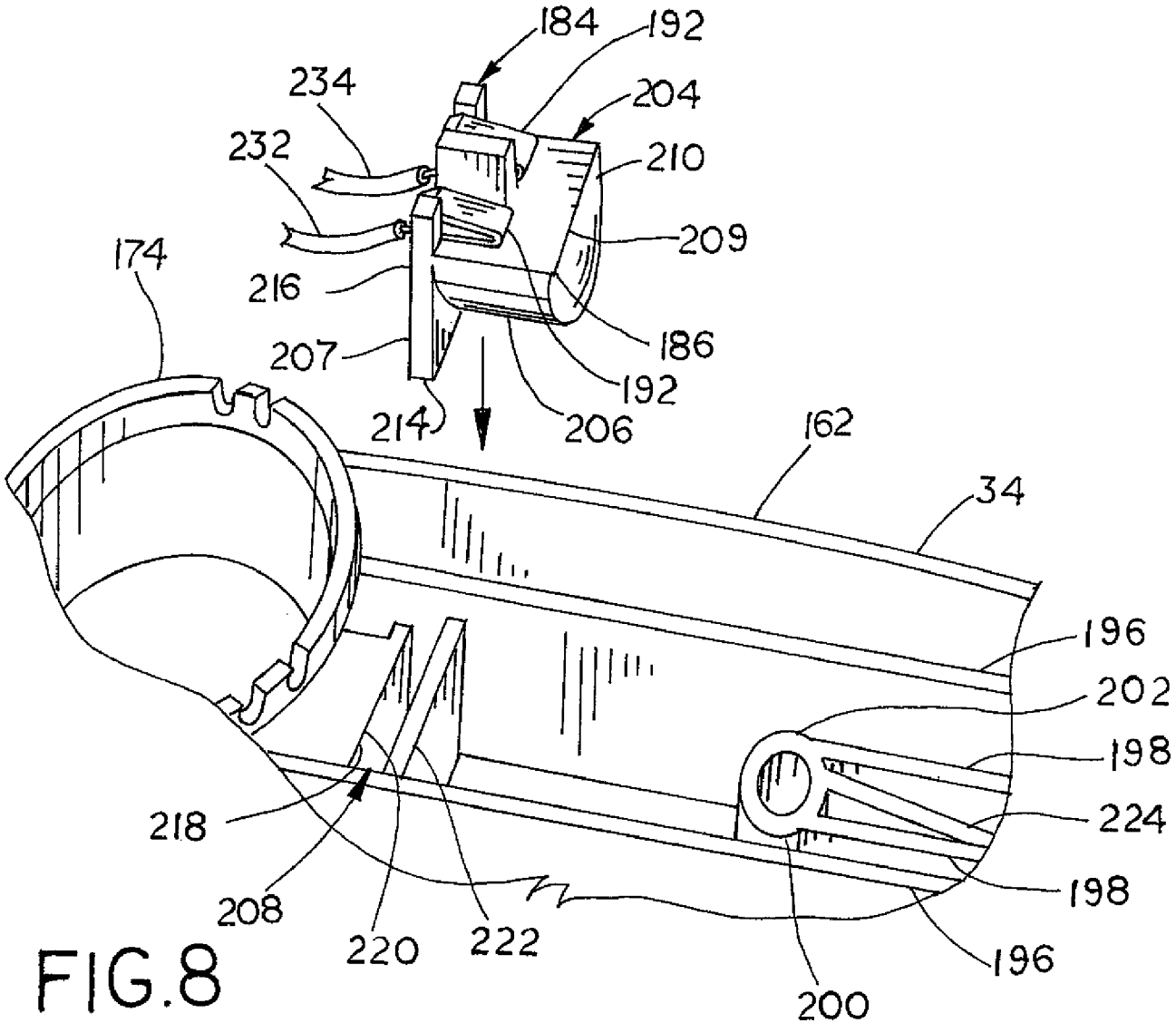
FIG. 8 is an exploded, perspective view of the device housing shell of FIG. 6 to show an exemplary contact assembly in accordance with several aspects of the disclosure.

FIGS. 7 and 8 depict the housing components of the intrinsic electrical connection in greater detail. The contact assembly 184 of this example includes an insert 204 shaped to engage the shell 162 between the outer rails 196 and, in so doing, position the contacts 192 for the electrical connection. To this end, the insert 204 defines the platform 186 on which the contacts 192 are mounted as part of a cantilevered support structure 206 that extends in the axial direction (FIG. 6) from an upstanding key 207 shaped to be received in a way 208. The support structure 206 in this example is shaped as a semi-cylindrical slug 209 to provide a flat surface for the platform 186, as well as a semi-circular front surface 210 that engages the end plug 86 of the leg 32. More specifically, the slug 209 and its front surface 210 are configured as a male projection to be received within the female receptacle formed by the semicircular opening 190 (FIG. 6) defined by the end plug 86. As the leg 32 is inserted into the housing 34 during assembly, the end plug 86 eventually reaches the support structure 206. As shown in FIG. 3, the end plug 86 includes a wall 212 defined by the base segment 130 of the end plug 86. After the support structure 208 is received within the opening 190, eventually the wall 212 contacts the front surface 210 of the support structure 206. In this way, the front surface 210 acts as a stop to limit axial travel of the leg 32 within the housing 34, and establish the structural connection at a position that ensures the electrical connection of the leg contact pair and the housing contact pair.

As shown more clearly in FIG. 8, the key 206 includes a support wall 214 that extends orthogonally away from the flat surface of the platform 186 at a rear side 216 of the insert 204. The support wall 214 is configured for cooperative engagement with a slot 218 of the way 207. In this example, the slot 218 is defined by a pair of parallel walls 220, 222, as well as the outer rails 196. The walls 220, 222 may be integrally formed with the outer rails 196, as well as any other component of the housing 34 or the half-shell 162 thereof.

The inner rails 198 are shown in the example of FIGS. 7 and 8 as terminating at the cylindrical recess 200 for ease in illustrating the components of the insert 204 and its engagement of the housing 34. Thus, the example is shown with the understanding that the inner rails 198 may continue to run beyond the cylindrical recess 200, as shown, for instance, in FIG. 6. The cylindrical recess 200 is also shown in FIGS. 7 and 8 as integrally formed with the inner rails 198, as well as a support rib 224 running in parallel and between the inner rails 198. The support rib 224 extends as an upstanding wall relative to the half-shell 162 in a sloped manner to act as a ramp for the snap connection. The support rib 224 may also provide axial strength for the structural connection of the housing 34 and the leg 32 (FIG. 6) once the components are in place.

With continued reference to FIGS. 7 and 8, the speaker basket 176 (FIG. 6) has been removed from the speaker chamber 174 to reveal the wiring path for the lines connected to the contact assembly 184. Grooves or notches 226, 228 are formed in a wall 230 that defines the speaker chamber 174 to allow wires 232, 234 to run from the contact assembly 186 to the electronics and other devices within the housing 34. This wiring path may be useful in cases where the outer rails 196 and other guides or walls (not shown) of the housing 34 enclose the leg 32 in the structural connection, thereby otherwise blocking the passage of wires.

Figures 9A, 9B, 9C:
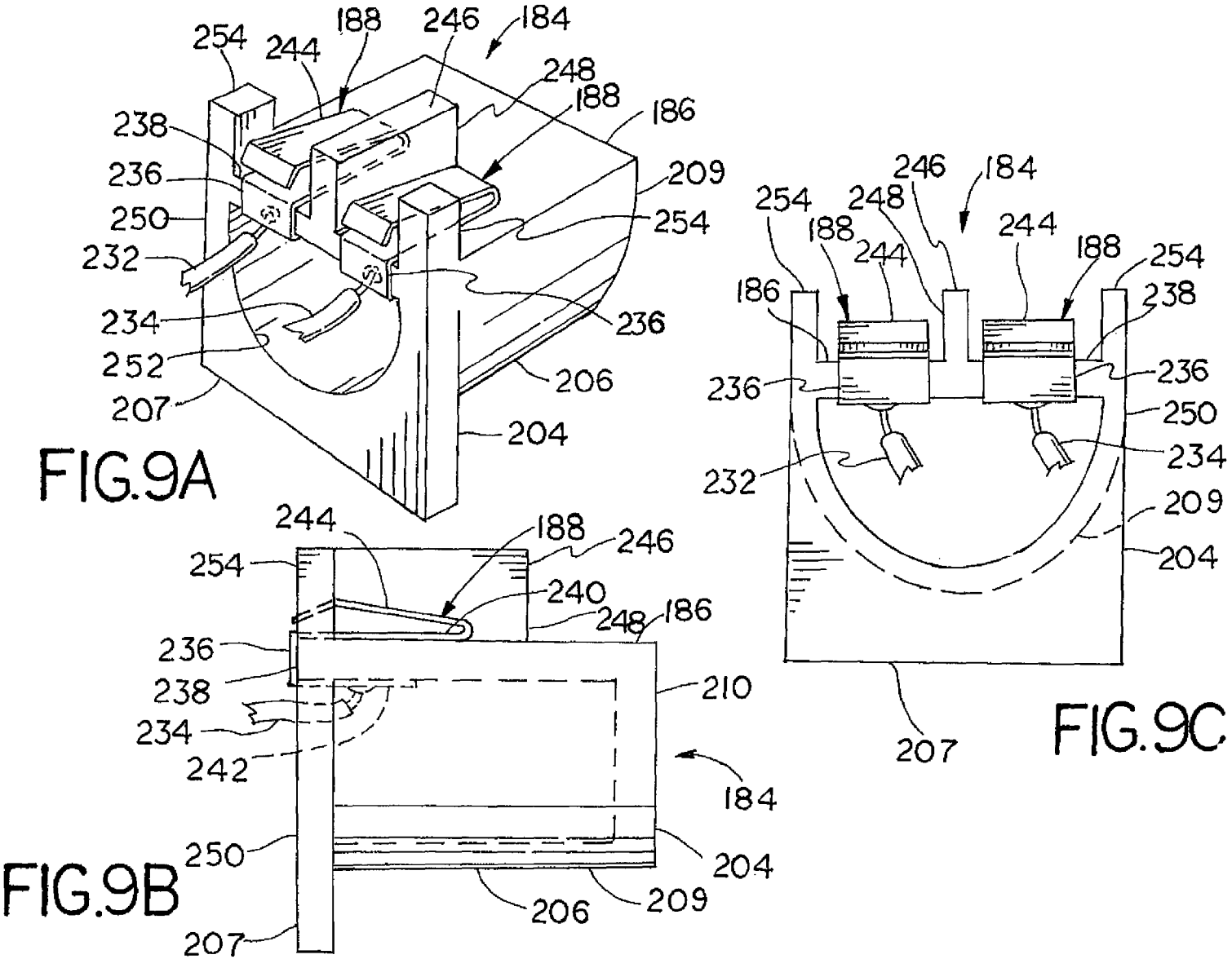
FIG. 9A is a rear, perspective view of the contact assembly of FIG. 8.
FIG. 9B is a side, elevational view of the contact assembly of FIG. 8.
FIG. 9C is a rear, elevational view of the contact assembly of FIG. 8.

In FIGS. 9A-9C, the insert 204 is removed from the housing 34 to depict the contact assembly 184 in greater detail. In this example, each contact 188 includes a U-shaped clip 236 configured to engage a rear edge 238 of the platform 186. Each clip 236 includes a strip bent to form upper and lower clasp sections 240, 242 (FIG. 9B) that grip and engage opposite sides of the platform 186. The clasp section 240 extends along the platform 186 a desired distance before folding over to form a spring 244 of the contact 188. Each spring 244 slopes upward from platform 186 when not engaged in the electrical connection to form a leaf-spring configuration, providing space for the spring 244 to be elastically deflected toward the platform 186 upon engagement with one of the contacts of the leg 32. A variety of other contact configurations may alternatively be used.

The contact assembly 184 may include an insulating spacer or divider 246 to help prevent a short circuit between the contacts 188. In this example, the spacer 246 includes an upstanding wall 248 that extends along and from the platform 186 to a desired extent. The wall 248 need not extend farther along the platform 186 than the length of the contacts 188, as in the example shown, and as best shown in FIG. 9B. The wall 248 may be integrally formed with the other, non-conductive components of the assembly 184, such as the support structure 206.

The key 207 of the exemplary contact assembly 184 shown in FIGS. 9A-9C may form part of a wall 250 that acts as a riser for the platform 186. In this case, the wall 250 includes a semi-circular opening 252 to accommodate the insertion of the clips 236 of the contacts 188. The shape of the opening 252 (FIG. 9A) generally corresponds with the shape of the semi-cylindrical slug 209, as the structure may be formed from an integral mold. The wall 250 may also include a pair of end posts 254 that extend orthogonally from the platform 186. Each post 254 helps to further confine one of the contacts 188, limiting any lateral movement and maintaining the axial orientation thereof The posts 254 may also engage the other half-shell of the housing 34 to secure the position of the contact assembly 184.

With reference now to FIG. 10, the intrinsic electrical connection may involve a variety of different contacts or contact assemblies. That is, the electrical connection need not involve the leaf-spring or strip-based contacts described above. For instance, one other exemplary contact configuration involves a leg 300 with an end 302 configured with a single jack plug 304 or other male projection to be received within another structural component of the swing, such as the housing 34 described above. In this example, the jack 304 includes a conventional headphone jack plug to be received by a matching socket in the other structural component.

The structural assembly involving the leg 300 may have a number of snap buttons 306 or other projections to limit and prevent any undesired axial displacement of the structural connection. Preventing axial displacement may be useful in connection with the electrical connection utilizing the jack plug 304 and other jacks similar to headphone jacks because the contact points in such connections are stacked cylindrical elements. In the example shown, for instance, the jack plug 304 includes contacts 308 and 310 separated by an insulator 312. The structural assembly may also include further components or features to prevent or avoid short circuits arising from an incorrect assembly or disassembly that would change the axial position of the contacts 308 and 310.

Figure 11:
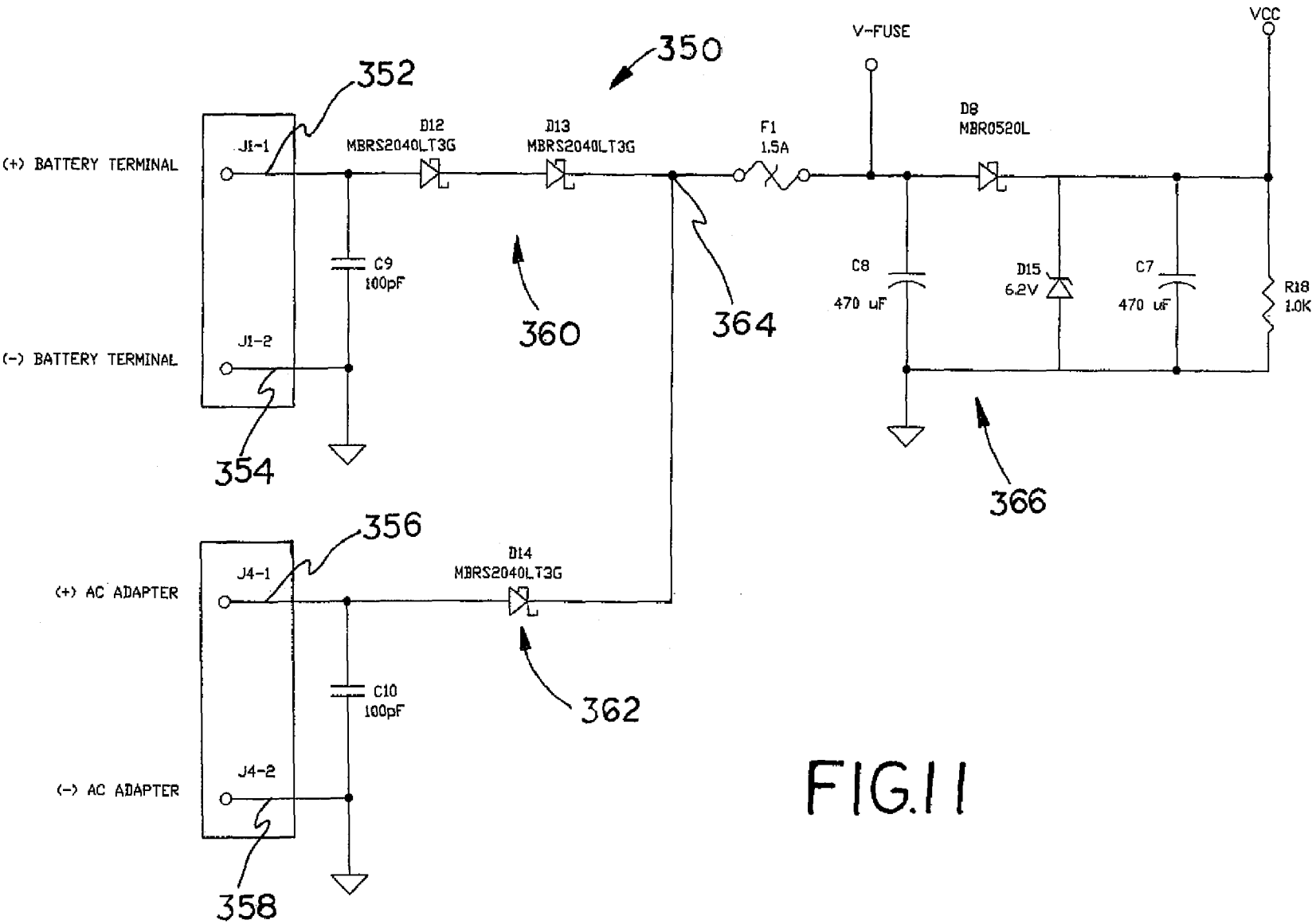
FIG. 11 is a schematic diagram of an exemplary power source control circuit configured in accordance with several aspects of the disclosure and for coupling to the intrinsic electrical connection(s) of the disclosure.

Turning to FIG. 11, a power source control circuit 350 may be electrically coupled to the above-described electrical connection to accommodate swings having a battery power source. The circuit 350 may be located along the conductive path that delivers power via the electrical connection. For instance, the circuit 350 may be located in the housing 34 to follow the electrical connection. In some cases, the circuit 50 may be disposed on the circuit board described above, to which both the battery power and AC line-derived power is delivered. In the example shown, the lines carrying the battery power are represented by, and coupled to, battery terminal lines 352, 354, while the line-derived power is represented by, and coupled to, AC adapter lines 356, 358. As described herein, the AC adapter lines are coupled to the circuit 350 by one or more intrinsic electrical connections not shown in FIG. 11. The DC voltages carried by these lines, as well as the battery lines, are conditioned by capacitors C9 and C10, respectively, to remove any transient, high-frequency noise, before being provided to respective isolation circuits 360, 362. Generally speaking, the isolation circuits 360, 362 isolate the power sources (or power source delivery paths) from one another, so that both power sources can remain connected to the electrical load(s) concurrently, as desired. In this way, the possibility for reverse current flow through, for instance, the battery(ies) is eliminated. The isolation circuits 360, 362 thus provide a safe mechanism for merging the two power delivery paths at a node 364. As a result, the electrical load(s) can switch between the power sources without requiring any action from the user if, for instance, the swing is plugged into the wall outlet, or the AC line power is lost.

In the example shown, each isolation circuit 360, 362 includes one or more Schottky diodes to provide the above-described isolation. The isolation circuit 360 includes Schottky diode D12, and the isolation circuit 362 includes Schottky diode D14. The isolation circuit 360 includes a further Schottky diode D13 to establish a voltage drop for the battery source line that is not mirrored in the AC line-derived power delivery path. The diode D13 also acts as a redundant safety device, insofar as failure of either of the diodes D12 or D13 does not result in loss of isolation, i.e., current flow from the AC adapter into the battery. In other cases, the diode D13 may be replaced with a resistor configured to provide the desired voltage drop. Commercially available Schottky diodes may be used for each of the diodes D12, D13, D14, including for instance the surface mount power rectifiers available under product number MBRS2040LT3G from ON Semiconductor (www.onsemi.com), although a wide variety of other diodes may be used.

In operation, the diode circuits 360, 362 rely on the similar and maximum levels of the two power sources to ensure that the node 364 is driven by the AC line-derived power when the swing is plugged into the wall outlet. When the two DC levels are roughly equal, the battery path does not conduct as the Schottky diode D13 introduces a voltage drop commensurate with a forward bias state. As a result, the diode D13 is effectively reverse-biased. The diode D13 is also reverse-biased when the AC line-derived voltage level is higher than the battery level. In the event that AC line-derived voltage level drops below the battery level, the AC line will continue to drive the voltage at the node 364 until the voltage differential exceeds the forward bias of the diode D13. The AC adapter may then be configured to maintain a DC voltage level above the maximum net battery voltage level to prevent this event from occurring under normal AC line power conditions. For example, in a three D-cell battery source embodiment, the maximum net battery voltage may be approximately 3.6 Volts (i.e., 4.5 Volts−0.45 Volts−0.45 Volts).

As a result, when the swing is plugged into the AC wall outlet, the diode circuit 362 sets the node 364 at a higher voltage than the diode circuit 360. The Schottky diode D13 is reverse-biased, thereby isolating the batteries, and the electrical load(s) are powered by the line-derived power In this way, the user need not make any adjustments or engage any switches when plugging the swing into the wall outlet.

In other cases, one or more of the diodes may be replaced with a respective transistor, such as a power MOSFET or bipolar junction transistor arranged to block reverse current flow. Each transistor would be configured to turn off when the AC adapter voltage is present. In this way, the voltage drop may be less than that resulting from having two isolation diodes in series, as in the example shown. A lower voltage drop may be useful in extending the overall battery life. More generally, a variety of other rectifying devices, circuits, and schemes may alternatively be used to allow the uni-directional current from the battery source. In each of these cases, the electrical load is powered either by the battery power source or via the power delivery path based on whether a power source voltage is present on the power delivery path. In this way, the juvenile product can automatically switch between power sources without requiring action by the caregiver. Yet another alternative approach to blocking reverse current flow (while avoiding the voltage drop of the above-described diode-based circuits) involves a mechanical switch in the AC-to-DC converter that also does not require action by the caregiver, as described further below.

The voltage level at the node 364 may be processed further before delivery to the circuit board or other electrical load(s). In the example shown in FIG. 11, a fuse F1 couples the above-described diode circuits to a voltage regulator 366 configured to establish a desired DC power source level, Vcc. The DC voltage level upstream of the regulation may also be used by one or more electrical loads (e.g., a DC motor), and is made available as V-fuse. The voltage source Vcc is generally set by a reverse-biased Zener diode D15, which, in this example, is configured to clamp any short-duration voltage spikes to a 6.2 Volt level. The desired level of the voltage source may be lower than the breakdown voltage of the Zener diode D15, and set by the AC adapter or the batteries. Capacitors C7 and C8 are provided to smooth the voltage sources Vcc and V-fuse, shunting away any current fluctuations from the power sources, such as any 60 Hz noise lingering from the AC line. In this way, the capacitors C7 and C8 help to provide a high-quality power supply for any microprocessor circuitry on the circuit board, and help to avoid any 60 Hz noise in audio reproduction. More generally, the capacitors C7 and C8 effectively act as a local DC power reserve downstream of the diode isolation circuitry described above. Also, a diode D8 and the capacitor C7 together help to isolate and protect the Vcc supply, which may provided to a microcontroller or processor, from large voltage dips at the voltage V-fuse, which may result from large currents going to a DC motor.

A resistor R18 is provided to bleed charge from the capacitors C7 and C8 when power delivery ceases. Otherwise, the charge stored in the capacitors C7 and C8 can keep the voltage at Vcc high for an undesirably long period of time, which, in turn, can keep the microcontroller or processor running for an undesirable time period. Such extension of processor operation may be inconvenient for a user attempting to reset the processor after, for instance, a processor lock-up due to a power dip or other issue. With the resistor R18, the voltage provided to the processor may decay to zero within 5-10 seconds, and the processor can then be reset.

A variety of different control and load circuits can be suitably coupled to, and powered by, the above-described circuitry and intrinsic electrical connection. Exemplary control circuits, control techniques, and electrical load devices for child swings are described in the above-referenced, commonly assigned, pending U.S. patent application. Examples of suitable motor drive systems and related techniques are described in U.S. Pat. No. 5,525,113 ("Open Top Swing and Control"), U.S. Pat. No. 6,339,304 ("Swing Control for Altering Power to Drive Motor After Each Swing Cycle"), and U.S. Pat. No. 6,875,117 ("Swing Drive Mechanism"), the entire disclosures of which are hereby incorporated by reference. In these and other examples, the load devices may include control circuitry with one or more microcontrollers for directing and monitoring the swing drive mechanism for startup, speed control, and other features, as well as directing audio and visual entertainment features for the child occupant, and a variety of user interface elements for the caregiver of either an input nature (e.g., touchscreen) or output nature (e.g., status LEDs or other lights). Exemplary control circuits, control techniques, microcontrollers, and other electrical load devices are also described in co-pending and commonly assigned U.S. application Ser. No. 11/932,641, entitled "Motor Drive Feedback Control for a Child Motion Device," and published as U.S. Patent Publication No. 2008/0139327, the entire disclosure of which is incorporated by reference.

Although a number of the examples described above involved a structural connection between a leg and a housing, the structural connection underlying the intrinsic electrical connection may involve one or more other legs, or one or more other frame components. Thus, the structural connection need not involve a housing, and accordingly may involve a coupling of two frame components, such as two sections of a frame leg to name but one example.

The above-described electrical and structural connections may also be useful in product shipping. With the structural connection between leg tubes and the housing (or other structural components), the structural components of the product may fit more compactly in a shipping arrangement. The leg tubes may also be shorter if, for instance, the structural connection involves two leg tubes. As a result, a smaller shipping carton or other container may be used.

The above-described approach to juvenile product power supply involves the minimal, if any, impact on the circuitry or functionality of the AC wall plug. The conversion circuitry in the AC wall plug can conveniently be housed in an enclosure of a typical size for AC/DC adapters. Moreover, practice of the above-described approach to juvenile product power supply may rely on conventional conversion electronics in the AC/DC adapter. Nevertheless, in some cases, the AC-to-DC converter may include a mechanical switch to provide the isolation features of the above-described diode-based circuitry. For example, the converter may be configured such that insertion of the plug into an AC wall socket causes a mechanical switch to toggle and disconnect the battery(ies) from the electrical load(s). In that case, a third wire may be routed through the cord(s) coupling the juvenile product to the converter to connect the switch and the battery power delivery path.

The other aspects of the power delivery paths may also be conventional, or vary as desired, as the disclosed intrinsic electrical connections need not involve or require any electrical wiring, cords or conduits of any specific type, size, form, or other characteristic. Accordingly, the power derived from the AC line may be carried by any electrical wire or set of wires, and thus may utilize any type of electrical line or conduit. Furthermore, the AC power need not be converted immediately at the wall plug jack, but rather may be transformed, converted, or otherwise adjusted at any point along the power delivery path.

Practice of the disclosed intrinsic electrical connection approach is not limited to any particular contact structure or design. For instance, in addition to the multiple examples of contacts described above, commercially available barrel connectors may be mounted within a end plug and a housing constructed with features similar to those described above to guide and establish the structural and electrical connections.

As described above, the structural connection between two structural components includes additional connective elements to establish an electrical connection intrinsically. While the connection itself may be more complex as a result of the additional connective elements, the assembly of the product remains easy for the caregiver. This simplification of assembly leads to a number of other advantages, including without limitation (i) avoiding pinched or short circuited wires, (ii) hidden wires as much as possible, (iii) a visually attractive design, (iv) a wall plug connection near the floor, (v) easy disconnection of the wall plug and swing to prevent tripping, (v) minimal, if any, impact to AC wall plug size, (vi) minimal cost, and (vii) compatibility with conventional AC wall outlet plugs and converter circuits.

The components and structures described above may be constructed from a variety of materials. Support structures may, for instance, be formed from various plastic materials, and the conductive elements from any one or more metals or metallic materials. In some cases, the end plugs described above may be formed as a plastic structure that is sufficiently rigid to guide the contacts together and shield the contacts during shipping and before assembly. Nevertheless, practice of the disclosed intrinsic electrical connection approach is not limited to any specific materials or material combinations.

The intrinsic electrical connections and isolation circuits described above may be used in connection with power sources other than one derived from an AC power line. For example, a juvenile product may have multiple battery power sources (conventional or rechargeable), or include a connection to a DC power source, such as an automobile battery.

Although certain products and devices have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A juvenile product comprising:

an electrical device;

a structural assembly configured to structurally support the electrical device, the assembly comprising a frame component configured to structurally support the juvenile product and a housing, wherein the structural assembly is formed via a structural snap connection of the frame component and the housing; and a power delivery path configured to carry power to the electrical device, the power delivery path being disposed within the frame component and the housing, respectively;

wherein the power delivery path comprises first and second elastic electrical contacts mounted, respectively, on a platform in the frame component and the housing, such that the first and second electrical contacts are automatically brought together by the structural snap connection between the frame component and the housing to establish an intrinsic, built-in electrical connection between the first and second contacts, wherein one of the frame component and the housing includes a spring with a button-shaped projection that is configured to engage a recess in one of the housing and the frame component.

2. The juvenile product of claim 1, wherein the frame component comprises a tube, wherein the power delivery path is routed through the tube, and wherein the first electrical contact is disposed within the tube.

3. The juvenile product of claim 2, wherein the frame component further comprises a plug inserted into an end of the tube, and wherein the plug encloses the first electrical contact.

4. The juvenile product of claim 3, wherein the plug comprises a snap connector configured to engage the tube to secure the plug within the tube and secure the tube within the housing.

5. The juvenile product of claim 1, wherein the frame component comprises a frame leg, and wherein the power delivery path is routed through the frame leg.

6. The juvenile product of claim 1, wherein the electrical device is disposed in the housing.

7. The juvenile product of claim 1, wherein the first and second electrical contacts are positioned within the frame component and the housing, respectively.

8. The juvenile product of claim 1, further comprising a battery power source and an isolation circuit coupling the battery power source to the power delivery path.

9. The juvenile product of claim 8, wherein the isolation circuit comprises an isolation diode.

10. The juvenile product of claim 9, wherein the power delivery path comprises a further isolation diode that couples the intrinsic electrical connection to the electrical device.

11. The juvenile product of claim 1, further comprising a battery power source and a circuit coupling the battery power source to the power delivery path, the circuit being configured to allow uni-directional current such that the electrical device is powered either by the battery power source or via the power delivery path based on whether a power source voltage is present on the power delivery path.

12. The juvenile product of claim 1, further comprising an AC-to-DC converter coupled to the power delivery path such that the power is derived from an AC line source.

13. A juvenile product comprising:

an electrical device;

a structural assembly configured to structurally support the electrical device, the assembly comprising a housing component in which the electrical device is disposed and a frame leg configured to support the juvenile product and for a structural snap connection with the housing component; and a power delivery path configured to carry power to the electrical device, the power delivery path comprising first and second power lines routed through the frame and housing components, respectively;

wherein the first and second power lines comprise first and second elastic electrical contacts, respectively, and wherein the first and second electrical contacts are mounted, respectively, on a platform within the frame leg and the housing component, such that the first and second electrical contacts are automatically brought together by the structural snap connection between the frame kg and the housing component to form an intrinsic, built-in electrical connection between the first and second power lines, wherein one of the frame leg and the housing component includes a spring with a button-shaped projection that is configured to engage a recess in one of the housing component and the frame leg.

14. The juvenile product of claim 13, wherein the frame leg comprises leg tube, wherein the first power line is routed through the leg tube, and wherein the first electrical contact is disposed within the leg tube.

15. The juvenile product of claim 14, wherein the frame leg further comprises a plug inserted into an end of the leg tube, and wherein the plug encloses the first electrical contact.

16. The juvenile product of claim 13, wherein one of the first and second electrical contacts includes a spring oriented for compression in a direction orthogonal to movement of the frame component to establish the structural connection.

17. The juvenile product of claim 13, further comprising a battery power source and an isolation circuit that couples the battery power source to the power delivery path.

18. The juvenile product of claim 17, wherein the isolation circuit comprises an isolation diode.

19. The juvenile product of claim 13, further comprising a battery power source and a circuit coupling the battery power source to the power delivery path, the circuit being configured to allow uni-directional current such that the electrical device is powered either by the battery power source or via the power delivery path based on whether a power source voltage is present on the power delivery path.

20. The juvenile product of claim 15, wherein the plug comprises a snap connector configured to engage the leg tube to secure the plug within the leg tube and secure the leg tube within the housing component.

21. The juvenile product of claim 20, wherein the snap connector comprises a cantilevered structured coupled to and extending away from the plug.

22. The juvenile product of claim 21, wherein the cantilevered structure is a serpentine extension.

23. The juvenile product of claim 21, wherein the cantilevered structure includes a spring with a button-shaped projection that is configured to engage a hole in the frame leg.

24. The juvenile product of claim 23, wherein when the spring is engaged in the hole in the frame leg, the button-shaped projection of the spring protrudes outward from the frame leg and is further configured to engage a recess in the housing component to form the structural snap connection between the frame leg and the housing component.

* * * * *